US009119249B2

(12) United States Patent
Yang et al.

(10) Patent No.: US 9,119,249 B2
(45) **Date of Patent: *Aug. 25, 2015**

(54) LED DEVICE, LED DRIVING CIRCUIT AND METHOD

(71) Applicant: NOVATEK MICROELECTRONICS CORP., HsinChu (TW)

(72) Inventors: Hsing-Chien Yang, Hsinchu County (TW); Wen-Hsin Cheng, Hsinchu (TW); Ying-Hao Hsu, Hsinchu (TW); Lan-Ting Hsu, Hsinchu (TW); Tsung-Hau Chang, Hsinchu (TW)

(73) Assignee: NOVATEK MICROELECTRONICS CORP., Hsinchu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/058,951

(22) Filed: Oct. 21, 2013

(65) Prior Publication Data

US 2014/0042917 A1 Feb. 13, 2014

Related U.S. Application Data

(63) Continuation of application No. 13/293,860, filed on Nov. 10, 2011, now Pat. No. 8,994,277.

(60) Provisional application No. 61/528,793, filed on Aug. 30, 2011.

(30) Foreign Application Priority Data

Sep. 29, 2011 (TW) ..... 100135367 A

(51) Int. Cl.
*H05B 37/02* (2006.01)
*H05B 33/08* (2006.01)

(52) U.S. Cl.
CPC ..... *H05B 33/0806* (2013.01); *H05B 33/0818* (2013.01); *H05B 33/0845* (2013.01)

(58) Field of Classification Search
None
See application file for complete search history.

(56) References Cited

U.S. PATENT DOCUMENTS

| | | | | |
|---|---|---|---|---|
| 5,381,077 | A | 1/1995 | McGuire | |
| 7,843,148 | B2 | 11/2010 | Gater et al. | |
| 2009/0105978 | A1* | 4/2009 | Schuttert et al. | 702/69 |
| 2010/0020004 | A1 | 1/2010 | Smith | |
| 2010/0084991 | A1 | 4/2010 | Liu et al. | |
| 2010/0164394 | A1 | 7/2010 | Liu | |
| 2010/0301764 | A1 | 12/2010 | Liu | |
| 2011/0032008 | A1* | 2/2011 | Zhao et al. | 327/114 |
| 2011/0074301 | A1* | 3/2011 | Goder | 315/210 |

FOREIGN PATENT DOCUMENTS

| | | | |
|---|---|---|---|
| CN | 101552548 | A | 10/2009 |
| TW | 201023148 | A | 6/2010 |

OTHER PUBLICATIONS

USPTO Office Action dated on Jun. 30, 2014 for U.S. Appl. No. 13/293,860.

* cited by examiner

*Primary Examiner* — Jany Richardson
(74) *Attorney, Agent, or Firm* — Rabin & Berdo, P.C.

(57) ABSTRACT

A light-emitting diode (LED) driving circuit includes an LED control circuit and a power stage circuit. The LED control circuit shifts an input pulse width modulation (PWM) signal toward a higher frequency direction in a frequency domain to generate an output PWM signal having a duty cycle substantially the same as a duty cycle of the input PWM signal. The power stage circuit outputs an LED driving current according to the output PWM signal.

12 Claims, 3 Drawing Sheets

LED DEVICE, LED DRIVING CIRCUIT AND METHOD

This application is a continuation application of co-pending application Ser. No. 13/293,860, filed on Nov. 10, 2011, now U.S. Pat. No. 8,994,277, the contents of which are incorporated herein by reference. This application claims the benefit of US provisional application Patent No. 61/528,793, filed Aug. 30, 2011, and Taiwan application Serial No. 100135367, filed Sep. 29, 2011, the subject matters of which are incorporated herein by reference.

BACKGROUND OF THE INVENTION

1. Field of the Invention

The invention relates to a light-emitting diode (LED) device and an LED driving circuit and method.

2. Description of the Related Art

At present, an LED tends to serve as a backlight module of a flat display panel. However, two polar plates of a capacitor of the LED driver tend to deform when the voltage and the current of the LED driver in the backlight module are always changing, and an inductor of the LED driver also generates the retractable deformation. The capacitor and the inductor generate audible noise in the deformation process.

SUMMARY OF THE INVENTION

The invention is directed to an LED device, an LED driving circuit and an LED driving method, in which an LED driving signal is shifted toward a higher frequency direction so that the frequency of the LED driving signal after frequency shifting exceeds the human auditory sensitivity.

According to a first aspect, an LED driving circuit including an LED control circuit and a power stage circuit is provided. The LED control circuit shifts an input pulse width modulation (PWM) signal toward a higher frequency direction in a frequency domain to generate an output PWM signal having a duty cycle substantially the same as a duty cycle of the input PWM signal. The power stage circuit outputs an LED driving current according to the output PWM signal.

According to a second aspect, an LED device is provided. The LED device includes one to multiple strings of LEDs and the LED driving circuit. The LED driving circuit is coupled to the one to multiple strings of LEDs and drives the one to multiple strings of LEDs.

According to a third aspect, an LED driving method is provided. The method includes the following steps. First, an LED control circuit is utilized to shift an input PWM signal toward a higher frequency direction in a frequency domain to generate an output PWM signal having a duty cycle substantially the same as a duty cycle of the input PWM signal. Next, a power stage circuit is utilized to output an LED driving current according to the output PWM signal.

The above and other aspects of the invention will become better understood with regard to the following detailed description of the preferred but non-limiting embodiment(s). The following description is made with reference to the accompanying drawings.

DETAILED DESCRIPTION OF THE INVENTION

According to the LED device, the LED driving circuit and the LED driving method in this disclosure, an LED driving signal is shifted toward a higher frequency direction in the frequency domain with its duty cycle kept unchanged, so that the frequency of the LED driving signal after frequency shifting exceeds the human auditory sensitivity and no noise is generated.

Figure 1A:
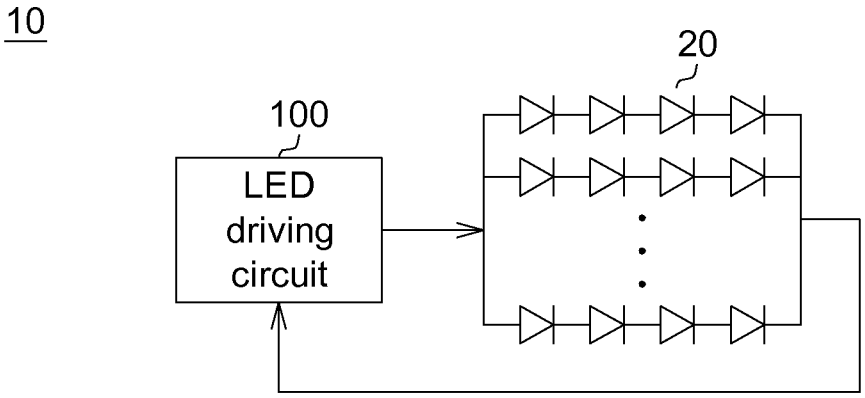
FIG. 1A is a schematic illustration showing an LED device according to an embodiment.
Figure 1B:
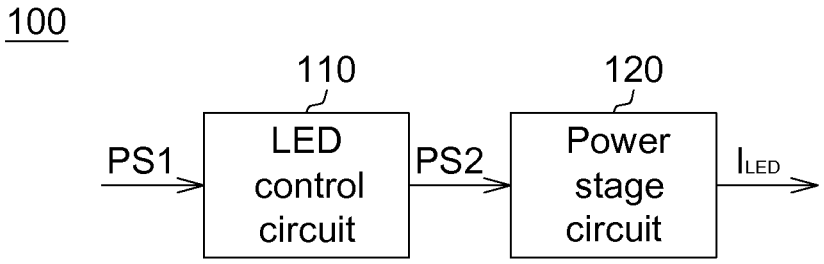
FIG. 1B is a block diagram showing an LED driving circuit according to an embodiment.

FIG. 1A is a schematic illustration showing an LED device 10 according to an embodiment. Referring to FIG. 1A, the LED device 10 includes one to multiple strings of LEDs 20 and an LED driving circuit 100. The LED driving circuit 100 is coupled to the one to multiple strings of LEDs 20 and drives the one to multiple strings of LEDs 20. FIG. 1B is a block diagram showing the LED driving circuit 100 according to an embodiment. The LED driving circuit 100 in FIG. 1B drives the corresponding LED in FIG. 1A to reach a predetermined light emitting brightness substantially according to an input PWM signal PS1. The LED driving circuit 100 includes an LED control circuit 110 and a power stage circuit. The LED control circuit 110 shifts the input PWM signal PS1 toward a higher frequency direction in a frequency domain to generate an output PWM signal PS2. The frequency of the output PWM signal PS2 after frequency shifting preferably exceeds the human auditory sensitivity (e.g., higher than 20 KHz or 22 KHz), and is more preferably higher than the detection range (25 KHz) of a microphone.

In addition, the input PWM signal PS1 is substantially an LED driving signal, so its duty cycle corresponds to the predetermined light emitting brightness. Thus, the LED control circuit 110 keeps the duty cycle of the output PWM signal PS2 to be substantially the same as the duty cycle of the input PWM signal PS1 so that the corresponding LED still can reach the predetermined light emitting brightness. A power stage circuit 120 outputs an LED driving current $I_{LED}$ to drive the corresponding LED according to the output PWM signal PS2.

Figure 2:
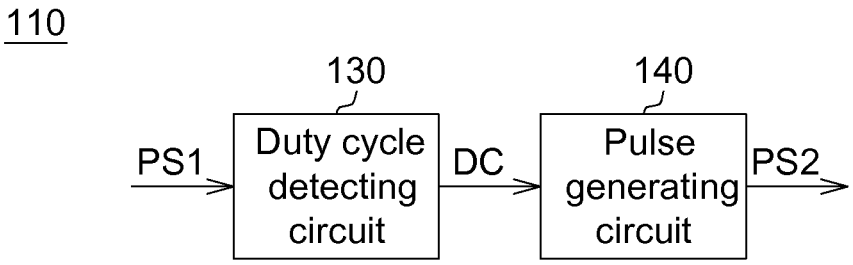
FIG. 2 is a block diagram showing an LED control circuit according to an embodiment.

FIG. 2 is a block diagram showing the LED control circuit 110 according to an embodiment. Referring to FIG. 2, the LED control circuit 110 includes a duty cycle detecting circuit 130 and a pulse generating circuit 140. The duty cycle detecting circuit 130 detects a duty cycle DC of the input PWM signal PS1. The pulse generating circuit 140 generates the output PWM signal PS2 according to the duty cycle DC of the input PWM signal PS1 and a predetermined frequency. The output PWM signal PS2 has a duty cycle substantially the same as the duty cycle DC of the input PWM signal PS1. The predetermined frequency is the frequency of the output PWM signal PS2. The LED control circuit 110 substantially shifts the input PWM signal PS1 from an original frequency to the predetermined frequency in the frequency domain to obtain the output PWM signal PS2, wherein the predetermined frequency is higher than the original frequency.

Figure 3A:
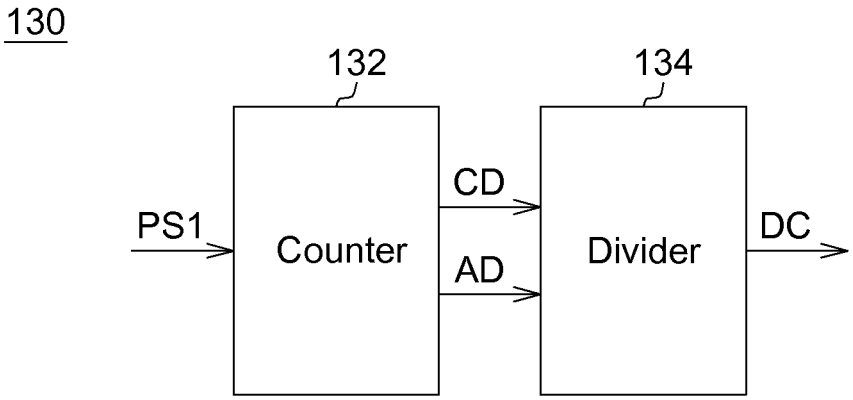
FIG. 3A is a schematic illustration showing an example of a duty cycle detecting circuit according to an embodiment.
Figure 3B:
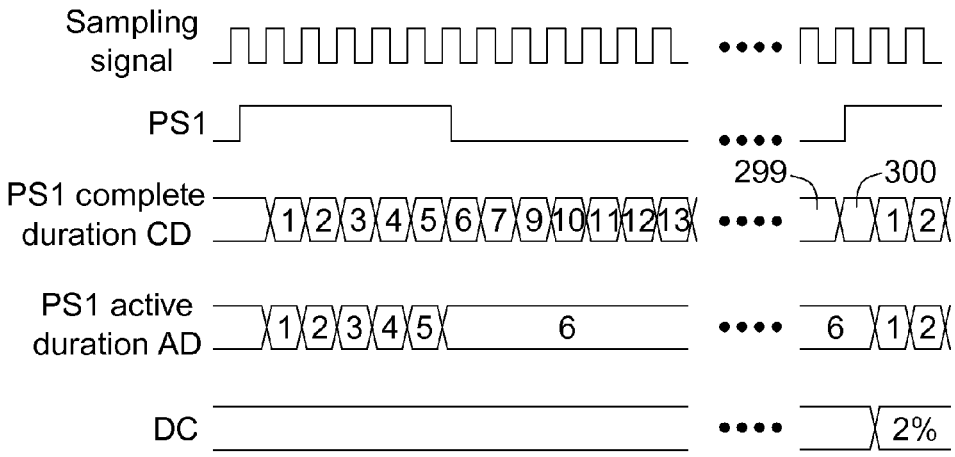
FIG. 3B shows waveforms in an example of the duty cycle detecting circuit according to an embodiment.

FIG. 3A is a schematic illustration showing an example of the duty cycle detecting circuit 130 according to an embodiment. FIG. 3B shows waveforms in an example of the duty cycle detecting circuit 130 according to an embodiment.

Figure 4:
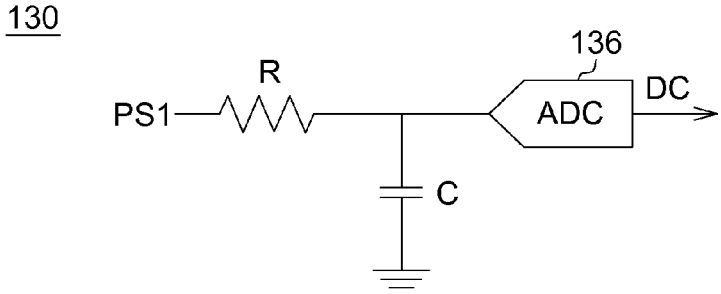
FIG. 4 is a schematic illustration showing another example of the duty cycle detecting circuit according to an embodiment.

Referring to FIG. 3A, the duty cycle detecting circuit 130 includes a counter 132 and a divider 134. Referring to FIG. 3B, the counter 132 obtains a complete duration CD of the input PWM signal PS1 and an active duration AD of the input PWM signal PS1 according to a sampling signal, and the divider 134 divides the complete duration CD by the active duration AD to obtain the duty cycle DC of the input PWM signal PS1. FIG. 4 is a schematic illustration showing another example of the duty cycle detecting circuit according to an embodiment. As shown in FIG. 4, the duty cycle detecting circuit 130 may also obtain the duty cycle DC of the input PWM signal PS1 through a simple RC circuit in conjunction with an analog-to-digital converter 136.

The invention also discloses an LED driving method including the following steps. AN LED control circuit is utilized to shift an input PWM signal toward a higher frequency direction in a frequency domain to generate an output PWM signal having a duty cycle substantially the same as a duty cycle of the input PWM signal. A power stage circuit is utilized to output an LED driving current according to the output PWM signal. A duty cycle detecting circuit of the LED control circuit is utilized to detect the duty cycle of the input PWM signal. A pulse generating circuit of the LED control circuit is utilized to generate the output PWM signal according to the duty cycle of the input PWM signal and a predetermined frequency.

The operation principle of the LED driving method has been described in the associated contents of FIGS. 1 to 4, so detailed descriptions thereof will be omitted.

In the LED driving circuit and method according to the embodiment, the input PWM signal is shifted toward the higher frequency direction in the frequency domain to obtain the output PWM signal, and the duty cycle of the output PWM signal is kept to be the same as the duty cycle of the input PWM signal. Consequently, the frequency of the shifted output PWM signal exceeds the human auditory sensitivity and no noise is generated, and the corresponding LED can be driven to reach the predetermined light emitting brightness without generating errors.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A light-emitting diode (LED) driving circuit, comprising:

an LED control circuit for shifting an input pulse width modulation (PWM) signal in a higher frequency direction in a frequency domain to generate an output PWM signal having a duty cycle substantially the same as a duty cycle of the input PWM signal, the LED control circuit comprising:

a duty cycle detecting circuit for detecting the duty cycle of the input PWM signal, wherein the duty cycle detecting circuit is configured to filter the input PWM signal to obtain an analog signal, and convert the analog signal into a digital signal indicating the duty cycle of the input PWM signal; and a pulse generating circuit for generating the output PWM signal according to the duty cycle of the input PWM signal; and a power stage circuit for outputting an LED driving current according to the output PWM signal.

2. The LED driving circuit according to claim 1, wherein the LED control circuit shifts the input PWM signal from an original frequency to a predetermined frequency in the frequency domain to obtain the output PWM signal, and the predetermined frequency is higher than the original frequency.

3. The LED driving circuit according to claim 1, wherein a frequency of the output PWM signal is higher than 20 KHz.

4. The LED driving circuit according to claim 1, wherein a frequency of the output PWM signal is higher than 22 KHz.

5. The LED driving circuit according to claim 1, wherein a frequency of the output PWM signal is higher than 25 KHz.

6. The LED driving circuit according to claim 1, wherein the duty cycle detecting circuit comprises:

a RC circuit configured to filter the input PWM signal to obtain the analog signal; and an analog-to-digital converter configured to convert the analog signal into the digital signal for obtaining the duty cycle of the input PWM signal in conjunction with the RC circuit.

7. An LED device, comprising:

one to multiple strings of LEDs; and the LED driving circuit according to claim 1, which is coupled to the one to multiple strings of LEDs and drives the one to multiple strings of LEDs.

8. An LED driving method, comprising the steps of:

shifting an input PWM signal in a higher frequency direction to generate an output PWM signal having a duty cycle substantially the same as a duty cycle of the input PWM signal, the step of shifting comprising:

detecting the duty cycle of the input PWM signal, the step of detecting comprising:

filtering the input PWM signal to obtain an analog signal; and converting the analog signal into a digital signal indicating the duty cycle of the input PWM signal; and generating the output PWM signal according to the duty cycle of the input PWM signal; and outputting an LED driving current according to the output PWM signal.

9. The method according to claim 8, wherein the step of generating the output PWM signal according to the duty cycle of the input PWM signal comprises:

shifting the input PWM signal from an original frequency to a predetermined frequency in a frequency domain to obtain the output PWM signal, wherein the predetermined frequency is higher than the original frequency.

10. The method according to claim 8, wherein a frequency of the output PWM signal is higher than 20 KHz.

11. The method according to claim 8, wherein a frequency of the output PWM signal is higher than 22 KHz.

12. The method according to claim 8, wherein a frequency of the output PWM signal is higher than 25 KHz.

* * * * *